US005199736A

United States Patent [19]

Jungkind

[11] Patent Number: 5,199,736

[45] Date of Patent: Apr. 6, 1993

[54] SAFETY SKI BINDING HAVING A PIVOTABLE SOLE PLATE

[76] Inventor: Roland Jungkind, Bärenalplstrasse 3, 8100 Garmisch-Partenkirchen, Fed. Rep. of Germany

[21] Appl. No.: 777,384

[22] PCT Filed: Mar. 12, 1991

[86] PCT No.: PCT/DE91/00218

§ 371 Date: Dec. 4, 1991

§ 102(e) Date: Dec. 4, 1991

[87] PCT Pub. No.: WO91/15272

PCT Pub. Date: Oct. 17, 1991

[30] Foreign Application Priority Data

Apr. 4, 1990 [DE] Fed. Rep. of Germany ..... 4010923

[51] Int. Cl.[5] ..... A63C 9/081

[52] U.S. Cl. ..... 280/618; 280/607; 280/634

[58] Field of Search ..... 280/618, 607, 617, 634

[56] References Cited

U.S. PATENT DOCUMENTS 3,950,003 4/1976 Korger ..... 280/634
4,957,305 9/1990 Freisinger et al. ..... 280/618

FOREIGN PATENT DOCUMENTS

0069753B1 8/1982 European Pat. Off. .
1478140B2 2/1970 Fed. Rep. of Germany .
2533337B2 2/1976 Fed. Rep. of Germany .
2531397 2/1977 Fed. Rep. of Germany ..... 280/618
3915911A1 12/1989 Fed. Rep. of Germany .
8804563 6/1988 World Int. Prop. O. ..... 280/618

*Primary Examiner*—Eric D. Culbreth
*Attorney, Agent, or Firm*—Hoffmann & Baron

[57] ABSTRACT

Described is a safety ski binding with a sole plate which can pivot about a pivot pin parallel to the surface of the ski and is connected to the ski. The sole plate is fixed in a central position, so that it cannot pivot laterally relative to the ski, by means of a spring-biased fixture fitted at the rear end of the sole plate, but the sole plate pivots out laterally relative to the ski against the spring bias when a given moment is exceeded. In order to avoid loading the pivot pin in the sole plate, and in the ski itself, by the force exerted by the spring, the invention calls for the fixture to have swivelling levers which, in their locking position, in which they hold the sole plate in its central position, rest against a stop disposed at right angles to the ski next to the swivelling levers.

4 Claims, 3 Drawing Sheets

SAFETY SKI BINDING HAVING A PIVOTABLE SOLE PLATE

The invention relates to a safety ski binding.

In a known plate-type safety ski binding of that kind (EP-A69 753), the sole plate on which the ski boot rests in use is connected to the ski by way of a pivot pin and resiliently fixed in a central position, in relation to a lateral pivotal deflection movement, by a holder which is arranged at the rear end of the sole plate. The holder has a base plate which is fixed with respect to the ski and which at its rearward edge is in the form of a curved track or path with a central retaining recess. Mounted at the rearward end of the sole plate, on an axially movable pin member, is a roller which is urged under the force of a strong spring into the retaining recess in the curved path or track and thereby fixes the central position of the sole plate. If the leg of the skier is subjected to the action of a torque which loads the sole plate in the direction of a lateral pivotal deflection movement, the holder then resists that pivotal deflection movement until the torque is such as to urge the roller out of the central retaining recess and on to the adjoining side portions of the curved path or track. Those side portions do not oppose any further lateral resistance to the roller so that the sole plate can be pivotally deflected sideways and the torque loading acting on the leg of the skier decreases.

The spring load which acts on the roller is considerable. By virtue of that spring force, on the one hand, the sole plate is correspondingly strongly pulled against the peripheral surface of the pivot pin, while on the other hand a corresponding reaction pressure force is formed in the portion of the ski between the pivot pin and the curved path or track. The strong pressure of the pin mounting in the sole plate against the peripheral surface of the pivot pin increases the degree of pin friction, in particular upon lateral pivotal movement of the sole plate; the pressure force which is operative in the ski can have a disadvantageous effect on the flexural characteristics of the ski and the flexural stresses which occur in the surface of the ski when the ski flexes.

Therefore the object of the present invention is that of proposing, on a safety ski binding of the specified kind, a holder for fixing the sole plate in its central position and for controlling same upon lateral pivotal deflection movement, which keeps the pivot pin free from increased friction and the ski portion between the pivot pin and the holder free from undesirable loadings. The invention further seeks to provide that the sole plate and the holder are still of a simple structure and easy to assemble.

As, in accordance with the invention, the sole plate is centered in its central position by a support for the pivot lever, which support is lateral as viewed in the longitudinal direction of the ski, the spring load which acts on the pivot lever and which must be overcome upon lateral release of the sole plate cannot give rise to any stressing of the sole plate and the ski in the longitudinal direction. For, at most the frictional force which results between the pivotal lever and the abutment is operative in the longitudinal direction of the ski. At the moment of lateral release therefore the pivot pin of the sole plate is substantially relieved of the effect of additional frictional forces so that easy pivotability of the sole plate is guaranteed, even when the ski binding involves high adjustment forces. In addition, no disadvantageous influences are exerted on the flexural characteristics of the ski, due to the fact that the portion of the ski between the pivot pin and the holder is no longer subjected to a loading.

The requirement for the ski binding to be kept free of holding forces which are operative in the longitudinal direction of the ski, as the invention seeks to achieve, is that the abutment is arranged laterally, as viewed in the longitudinal direction of the ski, relative to the pivot lever. That is achieved by any arrangement of the pivot axis of the pivot lever in a plane which is parallel to the longitudinal direction of the ski and which is perpendicular to the surface of the ski, and between a position which is parallel to and a position which is perpendicular to the surface of the ski. However, an upright arrangement of the pivot axis on the ski surface is preferred, as in that case the pivot lever is oriented in substantially the longitudinal direction of the ski or parallel thereto, and the holder can therefore be arranged in a flat and space-saving manner beneath the sole holder of the sole plate, at the heel end.

In regard to the co-operation of the pivot lever with the abutment, it is immaterial whether the pivot lever is arranged on the sole plate and the abutment is arranged fixedly with respect to the ski, or vice-versa. A preferred arrangement however is one in which the pivot lever or the pivot levers is or are arranged on the sole plate and the abutment is arranged on a base plate which is fixedly connected to the ski. The pivot lever then advantageously extends forwardly from its pivot axis in the longitudinal direction of the ski. If, as mentioned above, the pivot lever is intended to centre the sole plate in its central position, then each of the two side surfaces of the pivot lever must have, associated therewith, a respective abutment against which it bears. In that case the pivot lever projects into a position between the oppositely disposed abutments. That however presupposes highly precise fitting of the sole plate relative to the base plate which carries the abutments, and also involves close manufacturing tolerances. Preferably therefore in accordance with the invention the holder is provided with two respective pivot levers which are spring-loaded in mutually opposite pivotal directions and which bear under the spring loading against the abutment. As the two pivot levers are pivotable independently of each other, deviations between the position of the pivot levers and the abutment, which are caused by fitting and manufacture, are compensated by the spring loading the pivot levers.

When the arrangement has two pivot levers, they may bear against a common abutment which is arranged between them, in which case they are acted upon by the spring load in such a way that they are urged towards each other into their holding position. It is also possible however to associate a respective abutment with each pivot lever, so that the pivot levers lie between the two abutments and are spread away from each other in their holding position, by the spring loading.

The preferred arrangement of the pivot lever or levers such that they are secured to the sole plate and are directed from their pivot axis towards the tip of the ski provides an additional advantage insofar as, by virtue of that configuration, upon flexing of the ski and with resulting relative movement of the abutment with respect to the pivot lever in a forward direction the lever arm is increased in length and as a result the release force is reduced. For, a ski flexing effect in a downward direction occurs when the boot presses with an increased loading on the sole plate, thereby inevitably increasing the friction between the sole plate and the surface of the ski or those portions which are fixed with respect to the ski and on which the sole plate is supported. If, in the case of the ski flexing to a particularly substantial degree, which can result in a relative movement of the fixed abutment relative to the pivot levers in a forward direction of the order of magnitude of 1 mm, and if in that situation the sole plate is loaded laterally by a substantial torque, that is usually an indication of a particularly dangerous situation. Due to the above-mentioned relative displacement of the abutment which is fixed with respect to the ski, in a forward direction, there is a corresponding increase in the lever arm of the lateral support force which holds the equilibrium of the spring load acting on the pivot lever, in other words the release force is reduced. The sole plate can therefore be more easily released laterally, in a dangerous situation of that kind.

Further advantages and features of the invention will be apparent from the following description of embodiments with reference to the accompanying drawings, and from the subsidiary claims. In the drawings:

Figure 1:
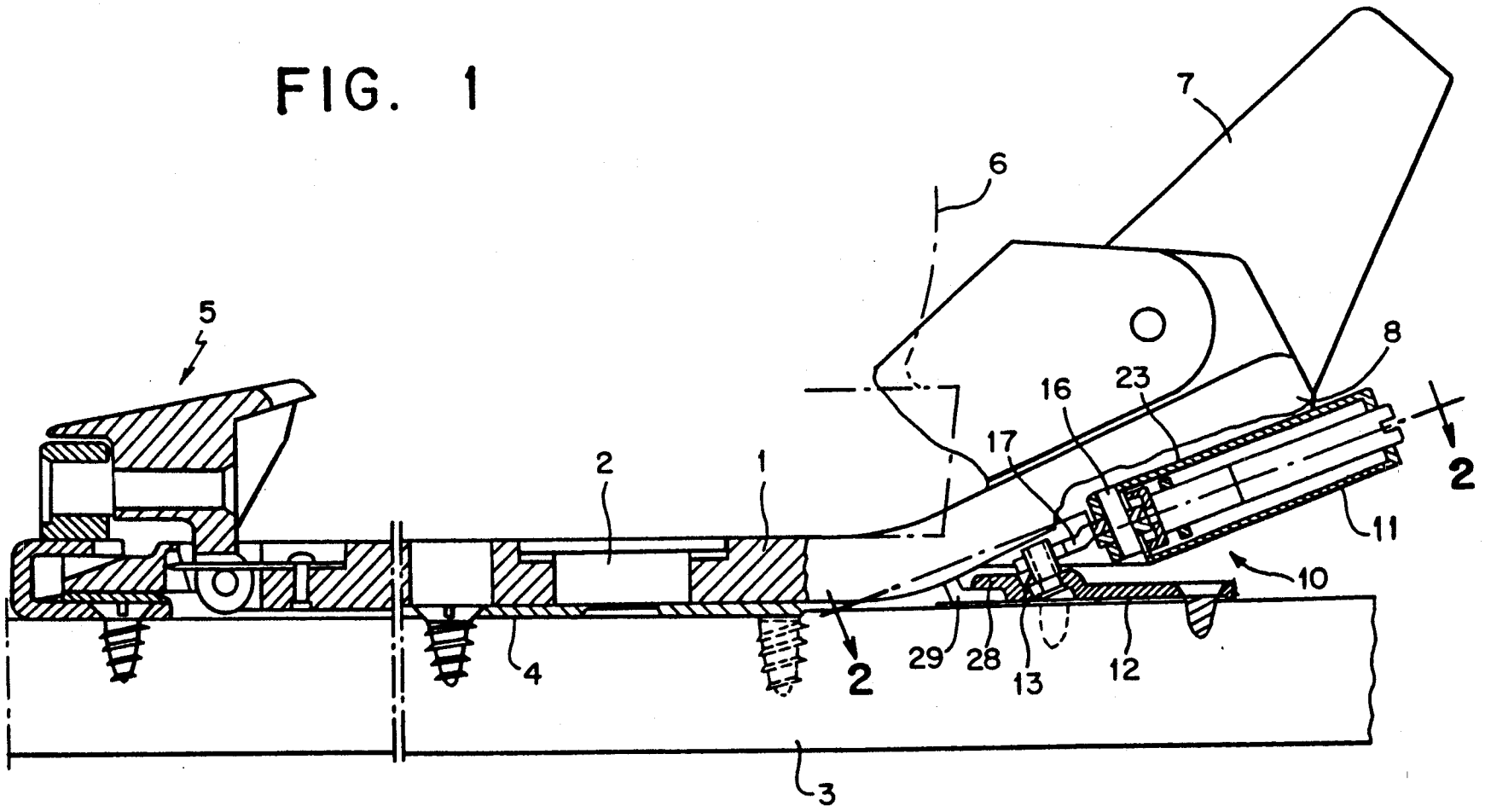
FIG. 1 is a partly sectional side view of a ski binding according to the invention, which is shortened in the longitudinal direction of the ski.

The safety ski binding shown in FIG. 1 comprises a sole plate 1 which is pivotable about a pivot pin 2 parallel to the surface of a ski 3 which is only indicated in the drawing. The pivot pin 2 is fixedly screwed to the ski 3 by means of a base plate 4.

Arranged at the front end of the sole plate 1 is a front sole holder 5 which embraces from above and from the side, the front edge (not shown) of the sole of a ski boot 6 which is shown in phantom. Fixed to the rear end of the sole plate 1 is a heel holder 7 which engages over the rear edge of the sole of the ski boot 6 and which is of such a configuration that it releases the edge of the sole when an upwardly directed holding force which is dangerous to the skier is exceeded. The front sole holder 5 and the heel holder 7 are not part of the present invention and are therefore not described in greater detail at this point. They may be of known kind and configuration (see EP-A 69 753).

Arranged at the underside of the inclinedly rearwardly and upwardly angled end portion 8 of the sole plate 1 is a holder which is generally identified by reference numeral 10 and by means of which, in use, the sole plate 1 is fixed and held in its central position in such a way that it can pivot out about the pivot pin 2 when a torque acting on the ski boot 6 towards the side is exceeded. The holder 10 comprises a spring portion 11 which is fixed to the end portion 8 in a manner which is not shown in greater detail, and base plate 12 which is screwed fast to the ski 3 and which carries an abutment 13 in the form of an inclinedly forwardly and upwardly directed pin or peg.

The spring portion 11 comprises a housing 15, at the front end of which two pivot levers 17 which are of mutually symmetrical configuration are mounted pivotably by means of a mounting pin 16. Each pivot lever 17 has a mounting eye 18 which sticks out laterally relative to its longitudinal extent and which at its rear side has a retaining notch 19. A bridge member 20 is supported in the retaining notches 19. The bridge member 20 is fixed, for example riveted, to the front end of a guide pin member 21 and is subjected to the force of a prestressed compression spring 22. The compression spring 22 is operatively disposed between the rear wall of the housing 15 and a spring plate 23 which is screwed on to a screwthread 24 on the guide pin member 21. The spring prestressing can be varied by means of a screwdriver slot 25 at the rearward end of the guide pin member 21 as the spring plate 23 is held non-rotatably but axially movably in the housing 15 in a manner which is not shown in greater detail in the drawing.

The pivot levers 17 are pivotably arranged with their mounting eyes 19 one above the other on the mounting pin 16, but they are cranked in regard to their further configuration so that they bear against oppositely disposed locations on the peripheral surface of the abutment pin or peg 13, in one and the same plane. In addition, at their mutually facing surfaces, the pivot levers 17 each have a recess 26, and the recesses 26 together form an opening for receiving the abutment 13 when the sole plate 1 is fitted on the ski.

Figure 2:
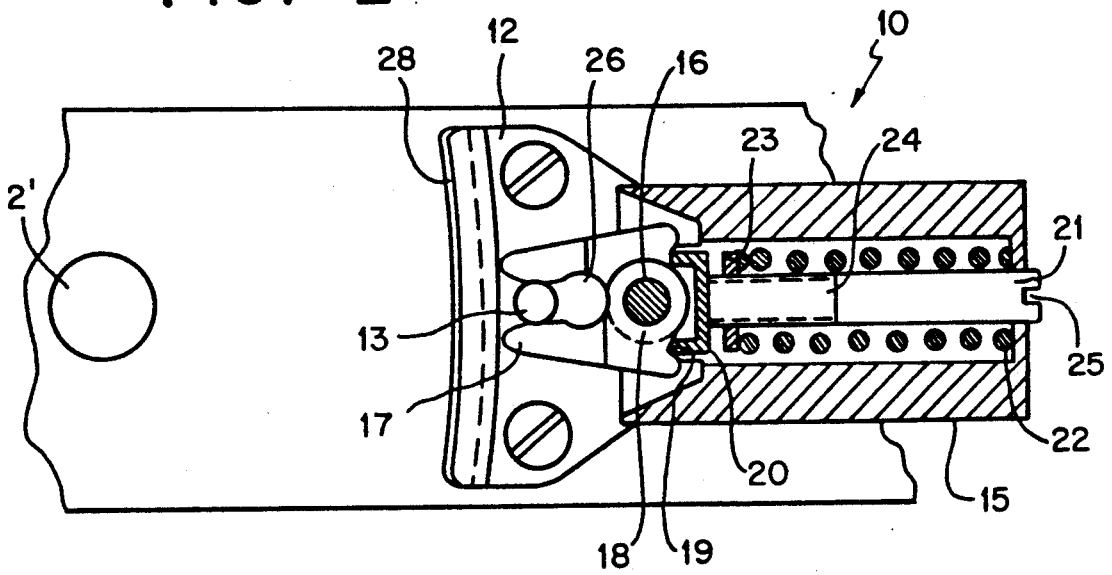
FIG. 2 is a view in section taken along line II—II in FIG. 1.

The inside surfaces of the pivot levers 17, which bear against the abutment 13, are each designed to form a curve in the manner shown in FIG. 2. The configuration of the curve determines the force/travel characteristic of the compression spring 22 upon lateral pivotal deflection movement of the pivot levers 17 and thus the torque/pivot angle characteristic of the sole plate 1 upon pivotal deflection movement. The aim is to give a torque/pivot angle characteristic which, when the sole plate 1 moves out of its central position, initially involves a steep rise to the release torque and then, during further pivotal movement to the condition of definitive release, a constant torque.

At its front end, the base plate 12 which carries the abutment 13 has a sliding guide 28, with an angled plate projection portion 29 of the sole plate 1 engaging under the sliding guide 28. In that way the sole plate 1 is held at its end portion 8 against a movement perpendicularly to the surface of the ski, and is guided during its sideways pivotal movement.

The end portion 8 of the sole plate 1 includes approximately an angle of 20° with the surface of the ski (see FIG. 1). The cooperating components of the holder 10 are also oriented in a corresponding fashion, that is to say the spring portion 11 including the pivot levers 17 is inclined at the same angle relative to the surface of the ski and the abutment 13 correspondingly involves an inclination relative to the line normal to the surface of the ski, also at the above-indicated angle, so that when the sole plate 1 moves sideways parallel to the surface of the ski, the pivot levers 17 can slide off in the peripheral direction against the cylindrical peripheral surface of the abutment pin 13.

For the purposes of fitting the sole plate 1 on to the ski 3, the flange of the pivot pin 2, which can be seen in FIG. 1, can be removed in a manner which is not specified in greater detail so that the pivot pin 2 can be inserted into a suitable recess 2'. As, under the force of the compression spring 22, the pivot levers 17 are pivoted until their inside surfaces mutually bear against each other, when the sole plate 1 is fitted in position the pivot levers are fitted on to the abutment pin 13, with the opening formed by the recesses 26. The sole plate can then be displaced rearwardly so that as a result the abutment pin 13 spreads the pivot levers 17 away from each other and puts them into their holding position. In that position the sole plate 1 can then also be fitted with the recess 2' on to the pivot pin 2 and fixed in position by re-fitting the flange on the pivot pin.

The mode of operation of the safety ski binding shown in FIGS. 1 and 2 is as follows: if a lateral torque which remains below a limit value set at the compression spring 22 is applied to the sole plate 1 by the ski boot 6, the sole plate 1 is centered in its central position by the lateral bearing forces of the pivot levers 17, which cancel each other out at the abutment 13. If the torque acting on the sole plate 1 increases to such an extent that the spring prestressing is overcome, then, in accordance with the direction of the torque, one of the pivot levers 17 is deflected, with simultaneous sideways pivotal movement of the sole plate 1, in the condition of bearing against the abutment 13. As a result, the bridge member 20 is displaced rearwardly by means of the retaining notch 19 of that pivot lever 17, and the compression spring 22 is further compressed by virtue of that movement of the bridge member 20. If the torque acting on the ski boot 6 persists, the sole plate 1 is further deflected, with the pivotal movement of the corresponding pivot lever 17 being maintained, until the ski boot is completely released from the sole plate 1, possibly by the front sole holder 5 or the heel holder 7 responding. Once the sole plate 1 has left its central position, the pivot levers 17 are also moved with the sole plate relative to the abutment 13, with increasing pivotal movement of the sole plate 1. However there is no further pivotal movement of the pivot levers 17 and thus no further compression of the compression spring 22 as the increasing angle of pivotal movement of the sole plate 1 with respect to the abutment 13 is compensated as a result of the curve formed at the inside surfaces of the pivot levers 17. As, in the central position of the sole plate 1, the lateral holding forces of the pivot levers 17 against the abutment 13 cancel each other out and even during the lateral pivotal deflection movement of the sole plate 1 only forces which are directed laterally transversely with respect to the longitudinal direction of the ski are applied to the abutment 13, the pivot pin 2 and the portion of the ski between the pivot pin 2 and the holder 10 remains uninfluenced by the holding forces of the pivot levers 17. For the same reason the above-indicated operation of fitting the sole plate 1 to the ski is possible without a tool for temporarily nullifying the spring loading of the compression spring 22.

Figure 3:
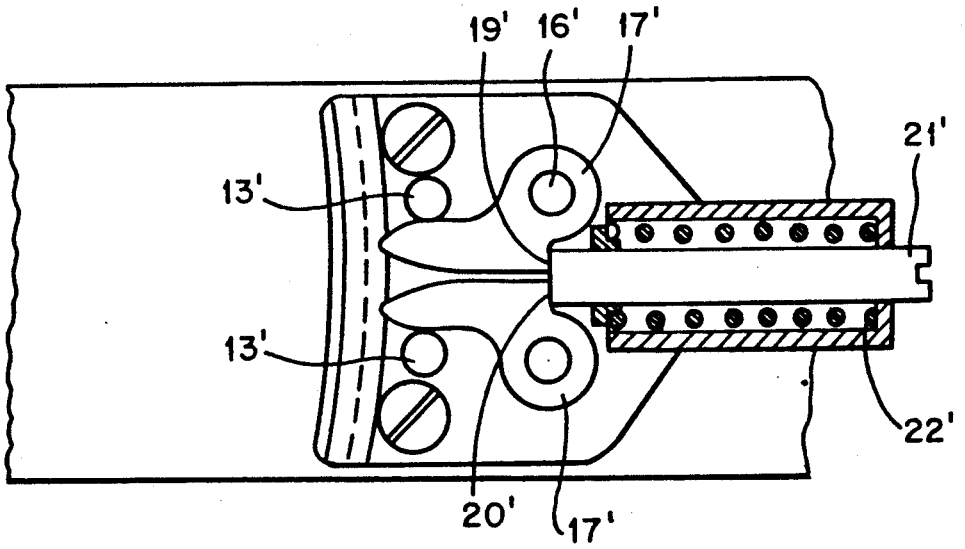
FIG. 3 is a sectional view similar to that shown in FIG. 2 of a modified embodiment of the holder.

The embodiment illustrated in FIG. 3 differs from that described above essentially only in that the pivot levers 17' are each independently mounted on their own mounting pin 16' and are spread away from each other by the compression spring 22'. For that purpose, the guide pin member 21 with its front end face 20' itself forms a bridge member, insofar as the end face 20' presses against a respective shoulder 19' on each of the pivot levers 17'.

The pivot levers 17' project in between two abutments 13' and bear with their outside surfaces against the abutments, under the force of the compression spring 22'. The above-mentioned outside surfaces are once again in the configuration of a curve which establishes the torque/pivot angle characteristic for the sole plate, in the same manner as described above.

The part of the shoulder 19' which extends parallel to the guide pin member 21' is at the lateral spacing shown in FIG. 3, from the front end of the guide pin member 21', being of such a size that that part of the shoulder, at a given spreading angle of the pivot levers 17', bears against the outside surface of the guide pin member 21' and prevents further spreading movement of the pivot levers 17'. That permits insertion of the pivot levers 17' between the abutments 13' when the sole plate 1 is fitted on the ski.

The pivot levers 17' can be arranged in the same plane as, upon lateral pivotal deflection movement of the sole plate 1 and a consequential pivotal movement of one of the pivot levers 17' inwardly, the other pivot lever 17' which is then no longer subjected to the spring loading can move out the way. Here also however it is possible for the pivot levers 17' to be cranked in such a way that they can also pivot over each other in the course of their pivotal movement.

Figure 4:
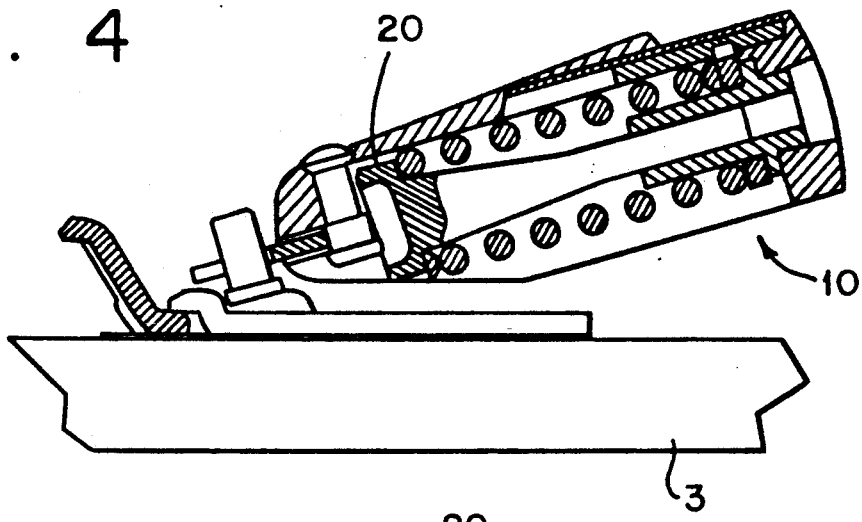
FIG. 4 is an elevational view, in partial section, of an alternative embodiment of the present invention.
Figure 5:
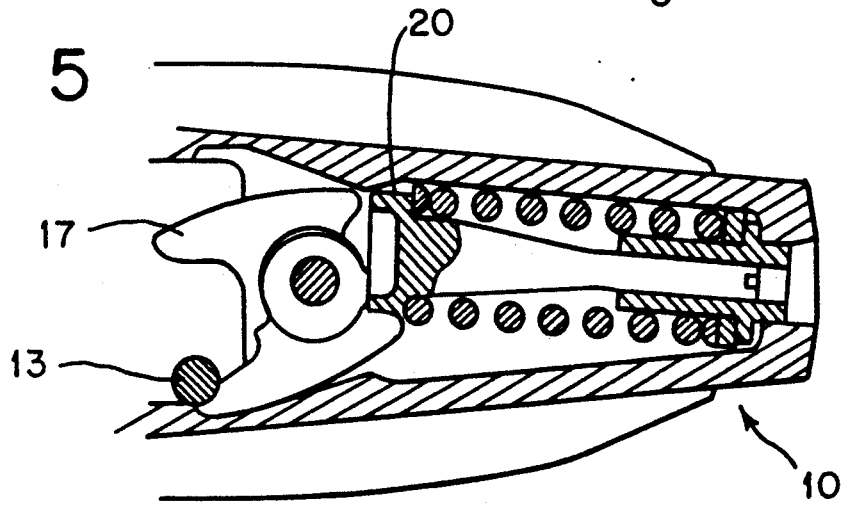
FIG. 5 is a view similar to FIG. 2 showing the embodiment of FIG. 4 in a release position.
Figure 6:
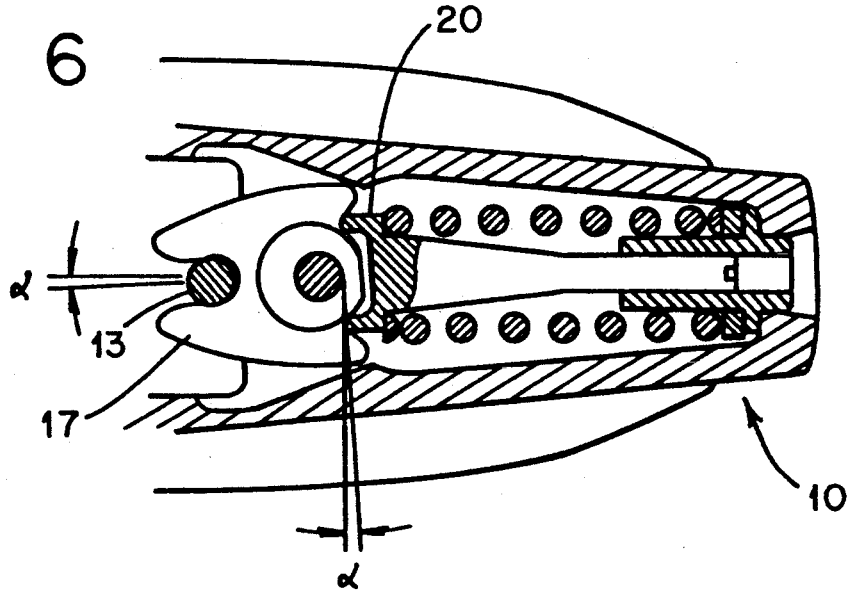
FIG. 6 is a view similar to FIG. 5 showing the pivot levers in a decentered position.

In the above-described embodiments, the bridge member 20 (FIG. 2) or the end face 20' of the guide pin member 21' (FIG. 3) are of a symmetrical configuration relative to the longitudinal axis of the respective guide pin member 21 or 21' respectively. As a result the bridge member 20 or the end face 20' urges the pivot levers 17 or 17' into a central position of being centered with respect to the ski. As a result, the ski plate 1 and with same the ski boot of the skier, which rests thereon, are held in the corresponding central position of being centered relative to the ski. However the structure according to the invention also permits a deliberate decentered position of the sole plate 1 relative to the ski. A deliberate decentered position of that kind is desired particularly by ski racers in order thereby to permit very precise alignment of the ski in relation to the individual foot attitude of the skier. In order to provide deliberate decentering of that kind, it is only necessary to depart from the symmetrical configuration of the bridge member 20 or the end face 20' relative to the longitudinal axis of the guide pin member 21 or 21' respectively. Thus for example, as shown in FIGS. 4–6, one side of the bridge member 20 which is supported in the associated retaining notch 19 in the one pivot lever 17 can be made shorter than the other side. In that way the pivot lever 17 which is associated with the shorter part of the bridge member 20 can pivot further rearwardly while the pivot lever 17 which is associated with the longer part of the bridge member 20 is pivoted further forwardly. The equilibrium position of the pivot levers 17, which is achieved in that way, thus provides for off-centre positioning of the opening which is formed between the two pivot levers 17 and in which the abutment 13 is disposed. In that way the sole plate 1 is also held in an off-centre position relative to the ski, that is to say at an angled relative to the longitudinal axis of the ski, as long as no side force above the limit value which is set at the compression spring 22 is acting on the arrangement.

I claim:

1. A safety ski binding comprising:

a sole plate having a front end and a rear end;

means for connecting the sole plate to a ski such that said sole plate is pivotable in a direction substantially parallel to the surface of the ski;

first and second pivot levers operatively associated with the rear end of said sole plate for holding said sole plate in a substantially central position, said pivot levers being pivotable between a holding position and a release position;

at least one abutment positioned proximate said pivot levers for supporting said pivot levers when said pivot levers are in said holding position;

a bridge member positioned adjacent said pivot levers; and a spring positioned adjacent said bridge member such that said spring presses said bridge member against said pivot levers to urge said pivot levers to said holding position, and wherein said pivot levers are urged in opposite directions to bear against said abutment.

2. A ski binding as set forth in claim 1 wherein the pivot levers include arms which are in opposite relationship with respect to the pivot axis of the pivot levers, and wherein the bridge member bears against said arms.

3. A ski binding as set forth in claim 1 wherein the pivot levers are of a symmetrical configuration with respect to a longitudinal center line of the sole plate.

4. A ski binding as set forth in claim 1 wherein the pivot levers are of a symmetrical configuration relative to a longitudinal center line of the sole plate and, wherein the bridge member is of an asymmetrical configuration with respect to said longitudinal center line.

* * * * *